US011229265B2

(12) United States Patent
Arendsen

(10) Patent No.: US 11,229,265 B2
(45) Date of Patent: Jan. 25, 2022

(54) KIT ASSEMBLY FOR ADAPTING A GEMSTONE BETWEEN MULTIPLE WEARABLE USE CONFIGURATIONS

(71) Applicant: Jon E. Arendsen, Dewitt, MI (US)

(72) Inventor: Jon E. Arendsen, Dewitt, MI (US)

( * ) Notice: Subject to any disclaimer, the term of this patent is extended or adjusted under 35 U.S.C. 154(b) by 0 days.

(21) Appl. No.: 17/091,032

(22) Filed: Nov. 6, 2020

(65) Prior Publication Data

US 2021/0153612 A1 May 27, 2021

Related U.S. Application Data

(60) Provisional application No. 62/941,138, filed on Nov. 27, 2019.

(51) Int. Cl.
*A44C 17/02* (2006.01)

(52) U.S. Cl.
CPC ..... *A44C 17/0233* (2013.01)

(58) Field of Classification Search
CPC . A44C 17/02; A44C 17/0208; A44C 17/0233; F16B 2200/10
See application file for complete search history.

(56) References Cited

U.S. PATENT DOCUMENTS 464,810 A * 12/1891 Bonner ..... A44C 17/0233 63/29.1
466,287 A * 12/1891 Berlepsch ..... A44C 17/0233 63/29.1
1,176,028 A * 3/1916 Botfield ..... A44C 17/0208 63/29.1
1,578,634 A * 3/1926 Borgmann ..... F16L 3/00 403/71
2,452,316 A * 10/1948 Morley ..... B60R 1/06 403/57
3,192,737 A 7/1965 Schechter et al.
4,165,621 A 8/1979 Gould
4,519,220 A * 5/1985 Burrell ..... A44C 17/0233 411/303
4,568,121 A * 2/1986 Kashima ..... B62J 1/08 297/215.15
4,726,200 A 2/1988 Carter
5,353,608 A 10/1994 Berkowitz
5,636,935 A * 6/1997 Beerens ..... B27B 17/08 403/241

(Continued)

FOREIGN PATENT DOCUMENTS

FR 766125 A 6/1934
GB 333448 A 8/1930

*Primary Examiner* — Emily M Morgan
(74) *Attorney, Agent, or Firm* — Dinsmore & Shohl LLP

(57) ABSTRACT

A kit assembly for converting a gemstone supporting head unit between alternate use configurations with jewelry not limited to any of a ring, pendent, brooch or bracelet. A head unit includes a plurality of upper setting prongs for supporting and securing a gemstone. The head unit can incorporate an underside engagement pattern or can be soldered onto a separate upper core. In a first variant, and upon pre-positioning the head unit in a supported fashion upon the jewelry item, a screw inserts through the open underside and engages at least opposing threads formed within the head unit. In a second variant, a lower core is attached or soldered to the jewelry item and inter-engages the upper core via the underside inserting screw.

4 Claims, 14 Drawing Sheets

(56) References Cited

U.S. PATENT DOCUMENTS

| | | | | |
|---|---|---|---|---|
| 6,532,765 | B1 * | 3/2003 | Hurwitz | A44C 17/02 63/15 |
| 6,612,132 | B2 | 9/2003 | Kimura et al. | |
| 6,820,442 | B2 | 11/2004 | Kimura | |
| 7,533,464 | B2 | 5/2009 | Roberts/Shea | |
| 7,856,849 | B2 | 12/2010 | McKeever et al. | |
| 2005/0056054 | A1 * | 3/2005 | Pourmehdi | A44C 9/0053 63/40 |
| 2012/0090356 | A1 * | 4/2012 | Liberman | A63B 23/16 63/3 |
| 2015/0231772 | A1 * | 8/2015 | Saftoiu | B25B 21/00 81/57.4 |

* cited by examiner

FIG. 24
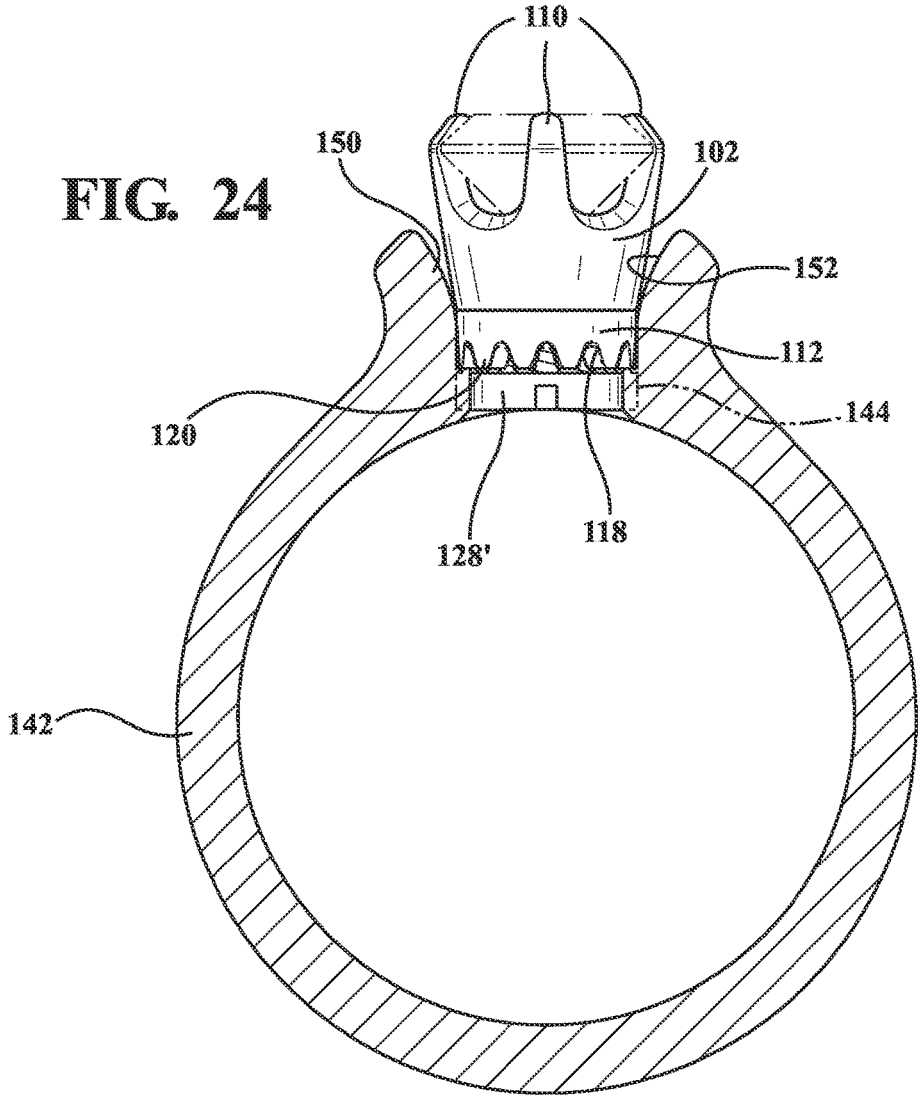
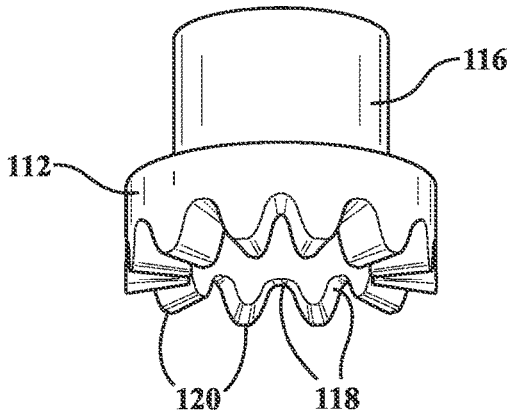
FIG. 25
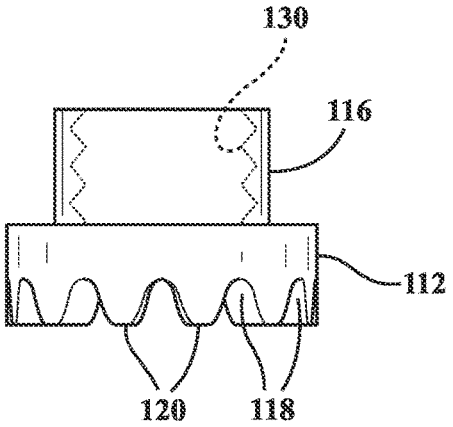
FIG. 26

KIT ASSEMBLY FOR ADAPTING A GEMSTONE BETWEEN MULTIPLE WEARABLE USE CONFIGURATIONS

CROSS REFERENCE TO RELATED APPLICATIONS

The present application claims the priority of U.S. Ser. No. 62/941,138 filed Nov. 27, 2019.

FIELD OF THE INVENTION

The present invention relates generally to jewelry items which are convertible between varying wearable or display-able applications. More specifically, the present invention discloses a kit assembly including a head unit supporting a gemstone or the like, the head unit being interchangeably mounted to a variety of wearable configurations not limited to any of finger ring shank, brooch or bracelet or pendent head unit by the user via a uniquely configured attachment screw and in order to provide for a variety of wearable or display-able configurations.

In an alternate retrofit configuration, a conventional gemstone mounting head unit is soldered or otherwise attached to an upper core portion. An inter-fitting lower core portion is secured to the wearable component (again by non-limiting example including any of a ring, pendant, bracelet or brooch). The upper and lower core portions each include opposing three dimensional mating profile for seating the upper core portion and attached head unit in a secure and non-rotational fashion. An underneath inserting screw is provided for inserting through an open interior of the lower core portion and threadably inter-engaging the upper core portion for securing the gemstone supporting head unit to the jewelry item. In given instances, the lower core portion with central aperture can be integrated into the design of the jewelry component.

BACKGROUND OF THE INVENTION

The prior art is documented with varying types of adaptable jewelry constructions, such as in which a gems. One example of this is disclosed in U.S. Pat. No. 4,726,200 which teaches a combination ring pendent having a gemstone mounted to a center piece by a unique locking mechanism and supported by a fixed pin extending between a semi-split shank. Other examples include the interchangeable ornamental ring of McKeever 7,856,849 as well as the combined finger ring and pendant of GB 333,448. U.S. Pat. No. 7,533,464, to Roberts/Shea, further teaches a jewelry ring and assembly method including a "U" shaped ring shank for mounting a bezel.

SUMMARY OF THE INVENTION

The present invention discloses a kit assembly for converting a gemstone supporting head unit between a plurality of decorative and alternate use configurations including, in non-limiting fashion, being engageable with a number of different wearable jewelry items not limited to a ring shank component in a first non-limiting use application, as well as being removable and separately attachable to a pendent base component in a second non-limiting use application. The head unit includes a plurality of upper setting prongs for supporting and securing an appropriately cut gemstone or other decorative component. Upon pre-positioning of the head unit in a supported fashion upon either of the ring shank or pendant base, a set screw inserts' through the open underside of the ring shank or pendant base and engages at least opposing threads formed within the head unit for securely supporting the same upon the shank or base.

In a further retrofit embodiment, a conventional gemstone mounting head unit is soldered or otherwise attached to an upper core. An inter-fitting lower core is secured to the wearable component (which again by non-limiting example can include any of a ring, pendant, bracelet or brooch).

Without limitation, the upper and lower core portions exhibit opposing, such as three dimensional, mating profile which can include such as peripheral extending undulation and recess profiles, In this fashion, the upper core and attached head unit is seated in a secure and non-rotational fashion to the lower core and jewelry item. An underneath inserting screw is provided for inserting through an open interior of the lower core portion and threadably inter-engaging the upper core portion for securing the gemstone supporting head unit to the jewelry item. In given instances, the lower core portion with central aperture can be integrated into the design of the jewelry component.

BRIEF DESCRIPTION OF THE DRAWINGS

Reference will now be made to the attached drawings, when read in combination with the following detailed description, wherein like reference numerals refer to like parts throughout the several views, and in which:

FIG. 24 is a succeeding assembled view of the reconfiguration of FIG. 23 and depicting the redesigned lower core in phantom in order to better show the seating arrangement of the set screw;

FIGS. 25-26 depict each of perspective and plan cutaway views of the upper core depicted in FIG. 22.

DETAILED DESCRIPTION OF THE PREFERRED EMBODIMENTS

With reference to the attached illustrations, the present invention discloses a kit assembly for converting a gemstone supporting head unit between a plurality of decorative and alternate use configurations including, in non-limiting fashion, being engageable with a variety of jewelry items including such as either of a ring shank component in a first non-limiting use application, as well as being removable and separately attachable to a pendent base component in a second non-limiting use application. As will be further described, the head unit includes a plurality of upper setting prongs for supporting and securing an appropriately cut gemstone or other decorative component. Upon pre-positioning of the head unit in a supported fashion upon either of the ring shank or pendant base, a uniquely configured set screw engages through the open underside of the ring shank or pendant base and engaging at least opposing threads formed within the head unit for securely supporting the same upon the shank or base.

Figure 1:
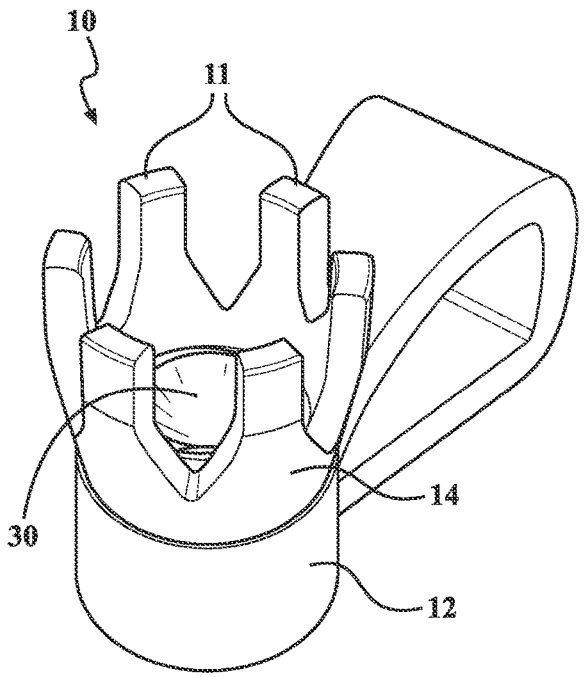
FIG. 1 is a perspective view and FIG. 1A a partially exploded view of a combination pendant base and attachable head unit according to a first non-limiting use application of the present invention.
Figure 1A:
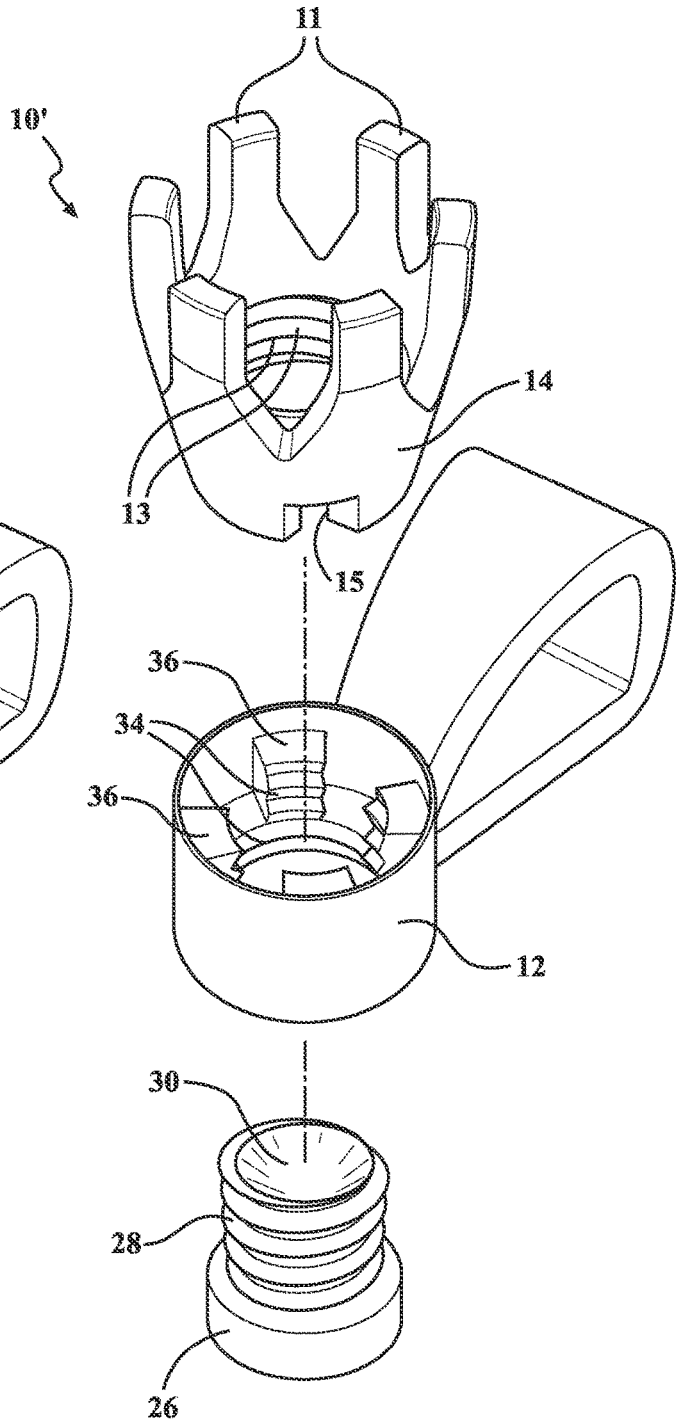

With reference initially to FIG. 1, a perspective view is shown generally at 10 and, with further reference to FIG. 1A, a partially exploded view 10' of a combination pendant base 12 and attachable head unit 14 according to a first non-limiting embodiment of the present invention. The head unit 14 includes a plurality of prongs 11 for gripping and retaining a gemstone (see at 2 in FIG. 8A). The head unit 14 of FIG. 1 further includes an annular interior with threads 13 for interengaging with the set screw (see at 26 in reference to FIG. 5).

Figure 6:
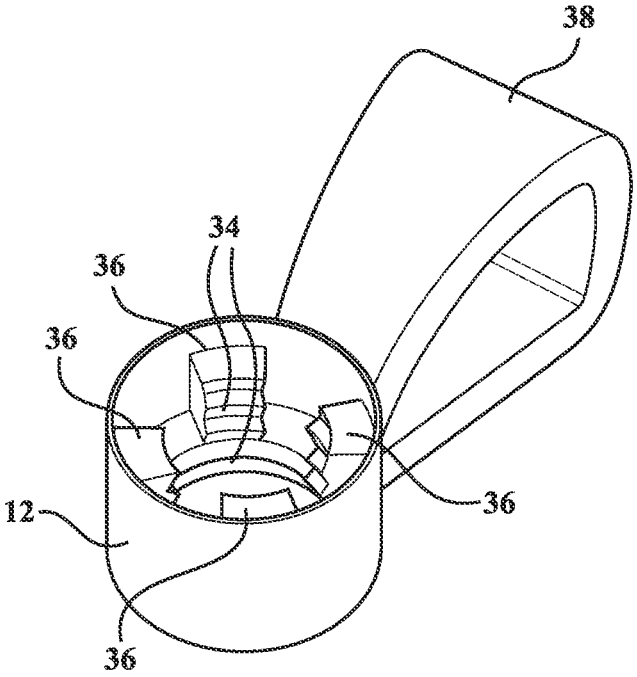
FIG. 6 is a downward looking perspective view of the separated pendant base of FIGS. 1 and 1A and depicting both the inner circumferential threaded profile for receiving the set screw as well as the interior projections which oppose and inter-engage with the underside seating profile of the head unit in order to support and secure the head unit in a non-rotating fashion within the pendant base upon insertion and tightening of the set screw.

The version of the head unit shown in FIG. 1 also includes a notched or recessed underside profile (see at 15) which seats the head unit upon the interior of the pendant base 12 (see in an anti-rotational fashion upon interior projections 36 in FIG. 6). Without limitation, the head unit 14 can include any desired underside array or pattern, for inter-engaging a mating opposing pattern in the pendant base 12 or other jewelry component and in order to prevent undesired rotation of the head unit following engagement to the base.

Figure 2:
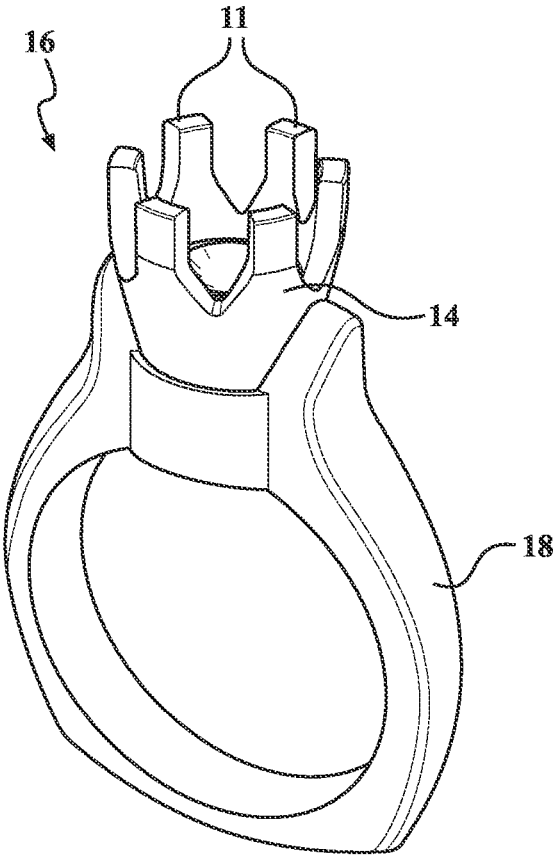
FIG. 2 is a perspective view and FIG. 2A a partially exploded view of a combination ring shank and attachable head unit according to a second non-limiting use application of the present invention.
Figure 2A:
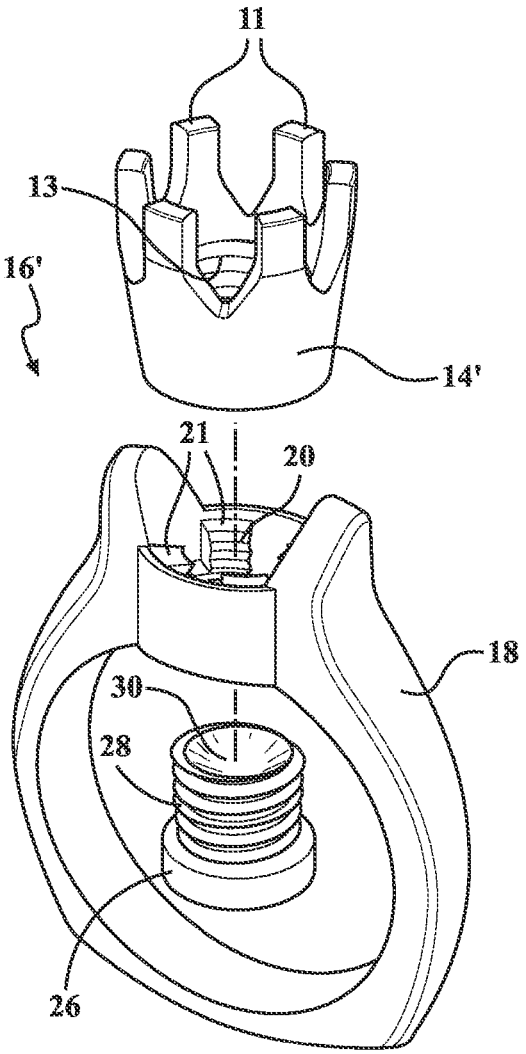

FIG. 2 presents a further perspective view 16 and FIG. 2A a partially exploded view, at 16', of a combination ring shank 18 and the attachable head unit (shown at 14' and similar to as previously identified at 14 and which can include either the underside notches 15 or exhibit a smooth profile) according to a second non-limiting use application of the present invention. For purposes of the present disclosure, the ring shank, pendant and head unit can all include any type of material or metal, such as which is customarily produced as a finer grade gold, silver, platinum or other precious metal which is typically associated with the jewelry business.

Figure 3:
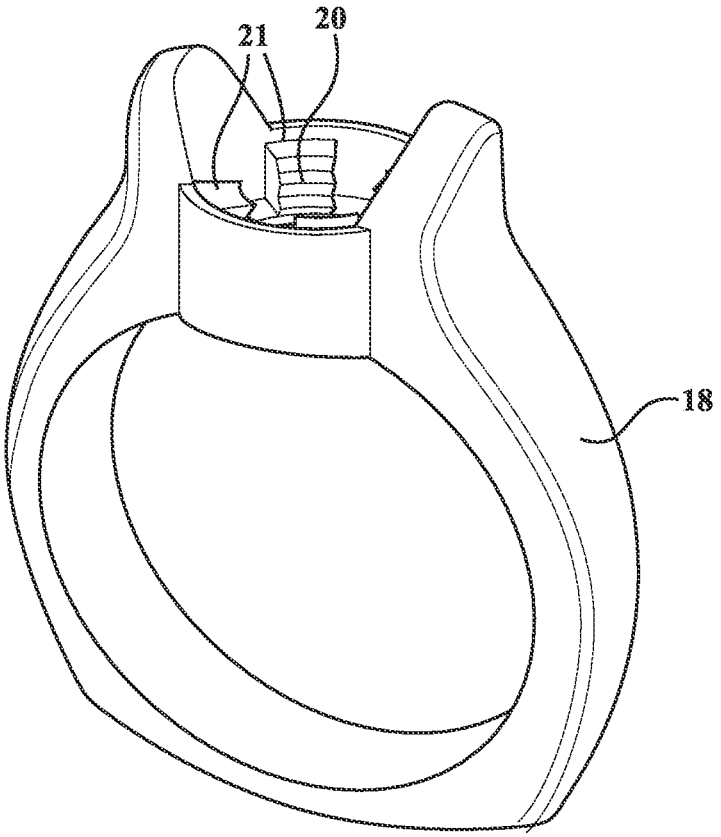
FIG. 3 is perspective view of the ring shank component as shown in FIG. 2A and better depicting the cross platform locking interior with threaded interior circumferential profile.

FIG. 3 is perspective view of the ring shank component 18 as shown in FIG. 2A and better depicting the cross platform locking interior defined by a bowl or other concave interior with threaded interior circumferential profile (see as depicted at 20 similar to that depicted at 34 associated with the pendant base 12 in FIG. 1A). Also included are offset inner projecting portions 21 configured within an upper accessible location of the ring shank which seat with mating underside projecting portions (not shown) associated with the head unit 14.

As will be described with reference to the alternate variants of FIGS. 13-15 for the ring shank and FIGS. 16-18 for the pendant, these components can be alternately configured without the provision of threads in use with the set screw and interiorly threaded attachable head unit. The ring shank 18 (as with the pendant 12) further defines an open perimeter adapted for supporting the head unit 14 in the manner described below as will as any type of inter-locking or inter-seating structure for supporting the head unit in a fashion to prevent rotation thereof or any misalignment.

Figure 4:
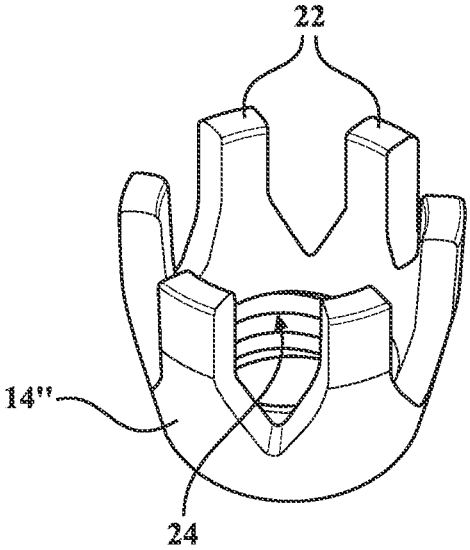
FIG. 4 is a separated view of the head unit shown in FIGS. 1A and 2A.

FIG. 4 is a separated view of a further related variant 14" of the head unit shown in FIGS. 1A and 2A, and which further depicts a plurality of engagement prongs 22 arranged in a perimeter defining array (see as further described with reference to related variant of FIGS. 8-8A) defining an open central interior 24 of the head unit. Although not clearly shown in this illustration, the head unit may further include any interior cutout or serrated configuration for fitting upon on a mating and opposing locking platform associated with any of a ring shank, pendant or other jewelry configuration.

Figure 5:
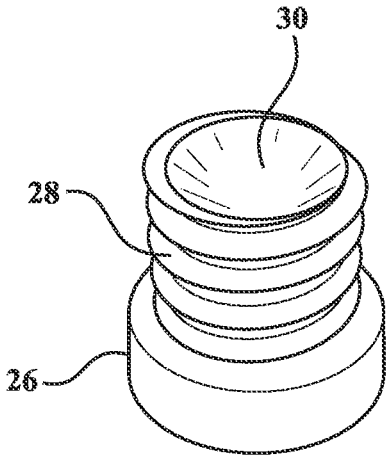
FIG. 5 is a separated view of the uniquely configured set screw component of the present invention for engaging through the interiorly threaded and open underside of either of the ring shank or pendant base and for mounting the upper supported head unit, the screw exhibiting an inward concave taper at its upper end for seating an opposing underside of the head unit secured gemstone.

Proceeding to FIG. 5, a separated view is depicted of a uniquely configured set screw component of the present invention for engaging through the interiorly threaded and open underside of either of the ring shank 18 or pendant base 12 and for mounting the upper supported head unit 14. The screw includes an enlarged head 26, an externally threaded stem or shaft 28 and an inwardly conically tapered end surface 30 at its upper end for seating an opposing underside of the head unit 14 secured gemstone (with further reference again to FIG. 8A).

Figure 10:
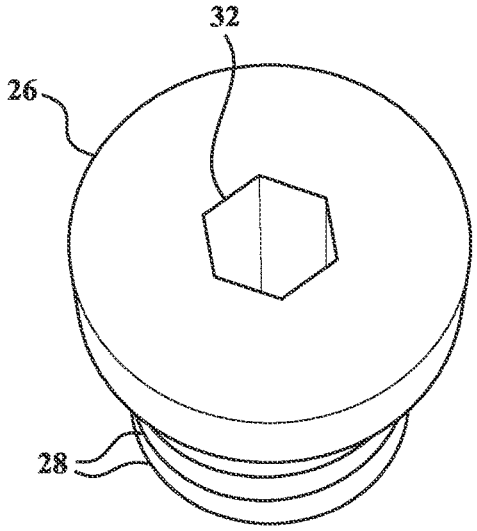
FIG. 10 is an end view perspective of the set screw and depicting a hexagonal Allen type bit receiving recess.
Figure 11:
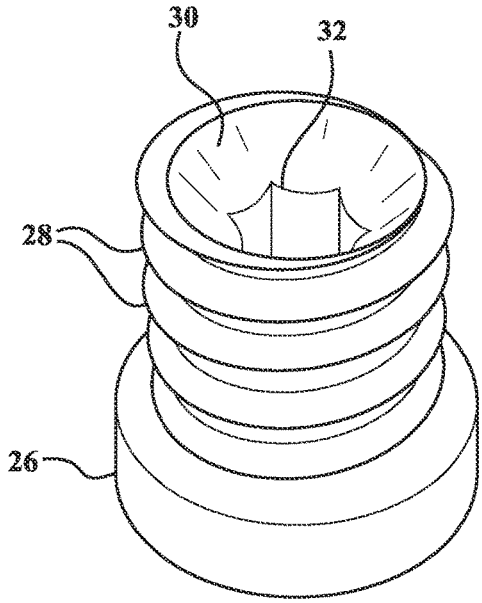
FIG. 11 is a side perspective of the set screw and depicting both the exterior threaded and circumferentially directed shank or shaft profile, in combination with the interior Allen style bit receiving recess which communicate with the interiorly concave tapered end surface for supporting against an underside of the mounted gemstone.
Figure 12:
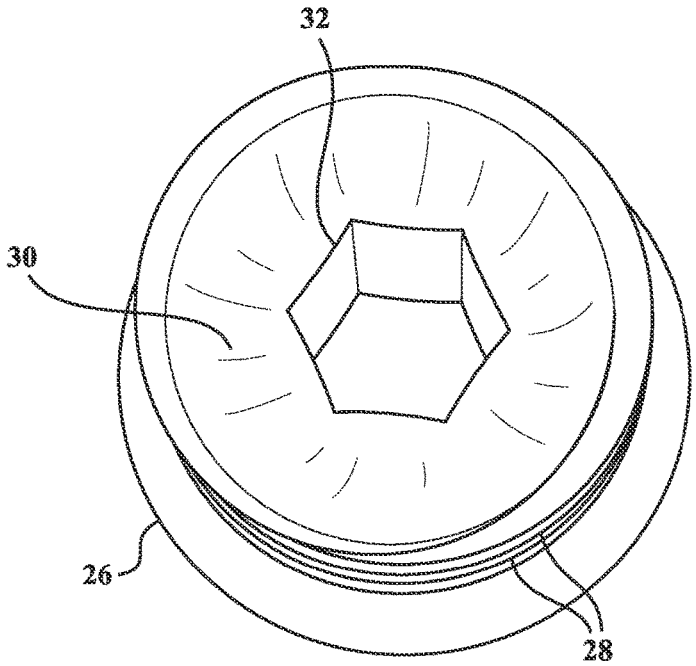
FIG. 12 is a further rotated plan view bottom illustration of the set screw as shown in FIG. 11.

With further reference to FIGS. 10-12, the set screw can further include a tool bit receiving recess (such as which is depicted by a hex shaped Allen bit receiving recess 32) which extends into the screw from the enlarged head 26 (and optionally through the tapered shank end 30). To this end, FIG. 10 is an end view perspective of the set screw and depicting a hexagonal Allen type bit receiving recess, with FIG. 11 further providing a side perspective of the set screw and depicting both the exterior threaded and circumferentially directed shank or shaft profile, in combination with the interior Allen style bit receiving recess which communicate with the interiorly concave tapered end surface for supporting against an underside of the mounted gemstone. FIG. 12 is a further rotated plan view bottom illustration of the set screw as shown in FIG. 11.

Without limitation, the bit receiving recess can be alternately configured and can be envisioned in alternate variants to only extend partially into the set screw in order to mount the head unit upon the ring or pendant base.

Figure 16:
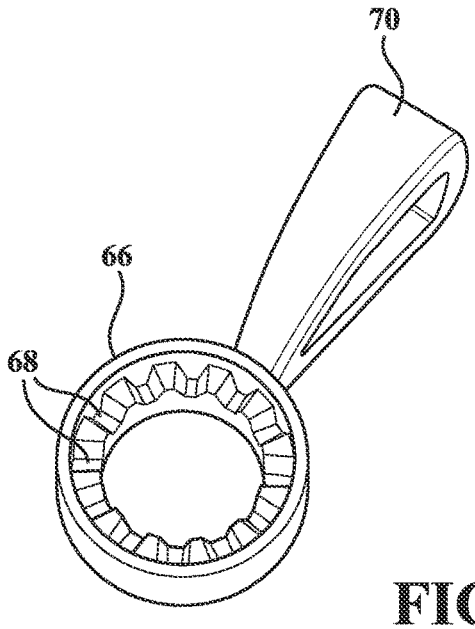
FIG. 16 a downward looking view of a modified pendant component in comparison to that shown in FIGS. 1, 1A and 6 and by which the pendant exhibits a shallower side profile without the provision of interior threads and for receiving the set screw in combination with an upper supported and interiorly threaded head unit, and (similar to the ring shank of FIG. 13) also including an alternate configuration of serrated interior projections which oppose and inter-engage with the underside seating profile of the head unit in order to support and secure the head unit in a non-rotating fashion within the pendant base upon insertion and tightening of the set screw.
Figure 17:
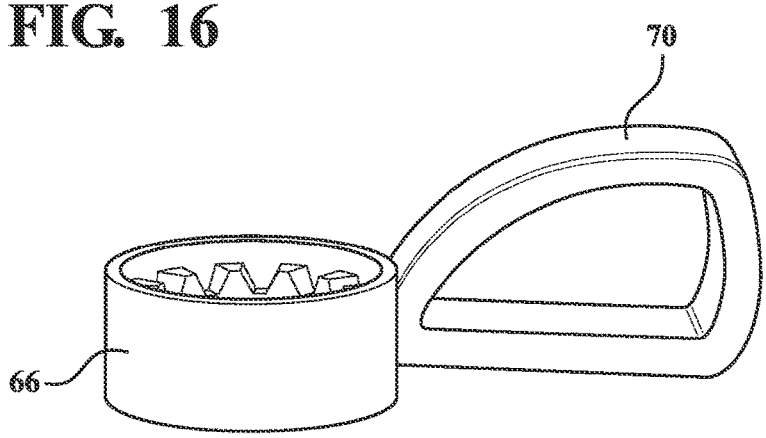
FIG. 17 is a side looking perspective of the pendant base of FIG. 16 and again depicting its shallower side profile in combination with the chain or other lanyard receiving loop which is integrally formed with the base.
Figure 18:
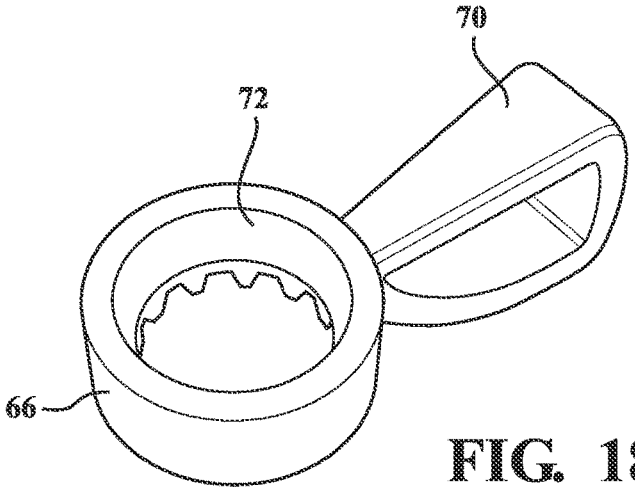
FIG. 18 is a rotated underside perspective of the pendant base bottom according to the alternate configuration of FIG. 16 and, similar to the ring shank bottom depiction of FIG. 15, depicts a reverse underside concave or inward taper for receiving the set screw so that the screw head is, upon being tightened, flush with an underside of pendant base.

FIG. 6 is a downward looking perspective view of the separated pendant base 12 of FIGS. 1 and 1A and depicting (similar to that depicted with the ring in FIG. 2A at 20/21) both an inner circumferential threaded profile 34 (optional as again noted with comparison to the alternate pendant configuration of FIGS. 16-18) for receiving the set screw as well as an arrangement of interior (also termed cross platform mounting) projections 36 which oppose and inter-engage with an underside seating profile of the head unit 14 in order to support and secure the head unit in a non-rotating fashion within the pendant base 12, upon insertion and tightening of the set screw. The pendant base 12 further includes any king of integrated loop portion 38 or the like, such as which receives a chain or lanyard of any type for suspended the assembly from the wearer's neck.

Figure 7:
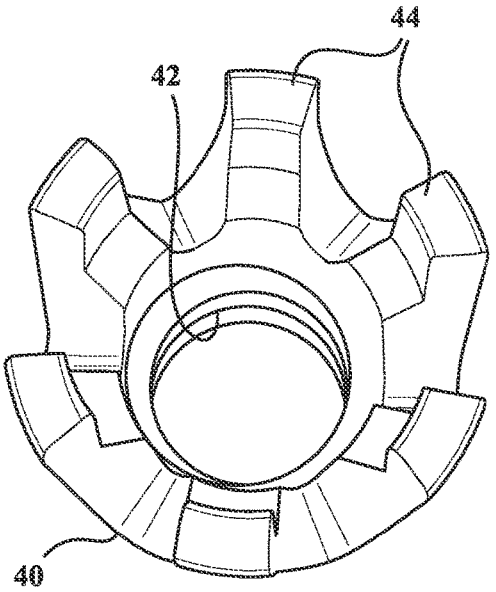
FIG. 7 is an enlarged and downwardly looking view of a further modified head unit in comparison to as shown in FIG. 4 and again depicting an interiorly circumferentially threaded profile for receiving the exteriorly threaded set screw.

The underside of the head unit 14 is further understood to include a corresponding array of cross platform nubs or projections which, upon setting the head unit upon the pendant or rink shank receiving interior, provide a stable supporting and non-rotating arrangement. Reference is further made to the description of modified head unit in FIGS. 7-9 presented below. In this manner, the present assembly allows for the same stone and head unit to be reliably swapped between different jewelry applications, not limited to ring shank and pendant base.

FIG. 7 is an enlarged and downwardly looking view of a further modified head unit 40 in comparison to as shown in FIG. 4, and again depicting an interiorly circumferentially threaded profile, see at 42, for receiving the exteriorly threaded set screw. FIG. 8 further presents a side perspective view of the head unit in FIG. 7 and better showing a similar peripheral array of gemstone engagement prongs, see at 44.

Figure 8:
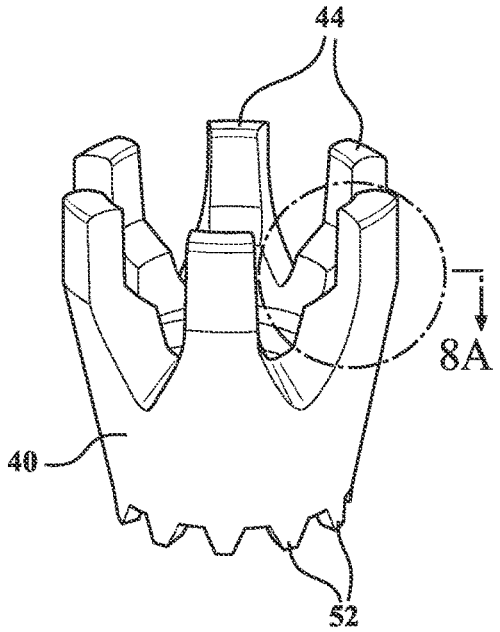
FIG. 8 is a side perspective view of the head unit in FIG. 7 and better showing the gemstone engagement prongs.
Figure 8A:
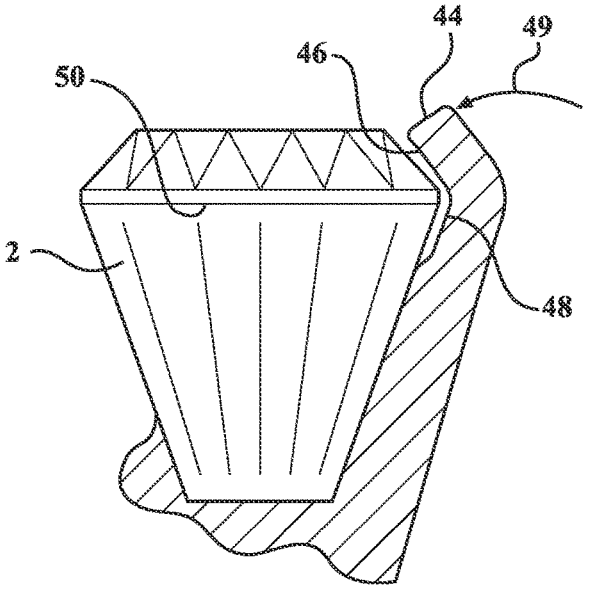
FIG. 8A is an enlarged partial view of a selected prong in FIG. 8 and depicting a conventional gemstone supported within the interior of the head unit in combination with the perimeter defined array of inwardly displaceable setting support prongs for securing the gemstone within and upon the head unit.
Figure 9:
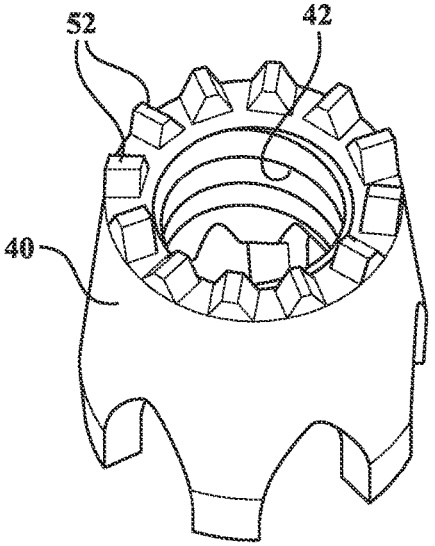
FIG. 9 is a further rotated bottom view of the head unit of FIGS. 7-8 and further depicting the circumferential underside serration projection array, as compared to the head unit of FIG. 4 and which, upon seating upon either of the pendent base or ring shank and attachment of the set screw, secures and prevents inter-rotation of the head unit.

FIG. 8A is an enlarged partial view of a selected prong 44 in FIG. 8 and depicting a conventional gemstone, at 2, supported within the interior of the head unit. As is conventionally known, the interior of each engagement engagement prong 44 can include an inside angular orientation, see at 46/48 and which, upon being displaced inwardly as depicted by arrow 49, engages the angularly oriented surfaces of the selected prong against contiguous angled or oriented surfaces of the gemstone setting 2, this further depicted by angular separation line 50 which defines a greatest diameter of the gemstone.

FIG. 9 further provides a rotated bottom view of the head unit 40 of FIGS. 7-8 and depicting a non-limiting arrangement of circumferential underside serrations (see portions 52), as compared to the head unit of FIG. 4 and which, upon seating upon either of the pendent base or ring shank and attachment of the set screw, secures and prevents inter-rotation of the supported head unit.

Figure 13:
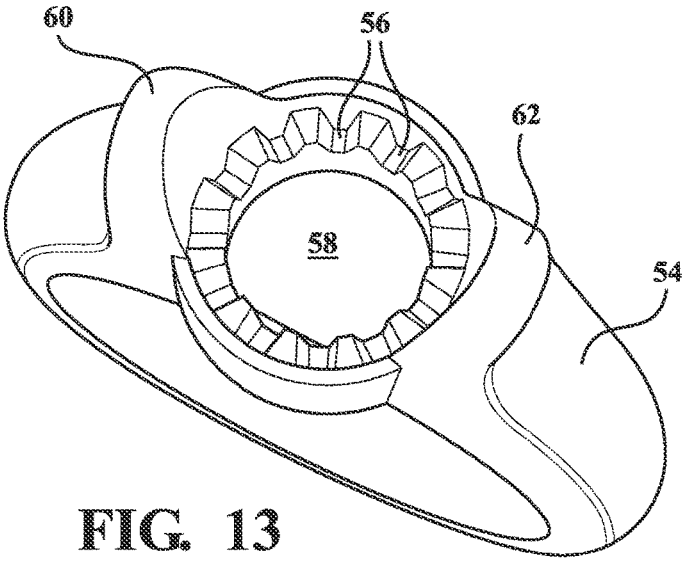
FIG. 13 is a downward looking perspective view of a separated and slightly modified ring shank as compared to that shown in FIGS. 2, 2A and 3 of FIGS. 1 and 1A and depicting a shallower support base without the inner circumferential threaded profile for receiving the set screw, in combination with the upper supported and interiorly threaded head unit, as well as an alternate configuration of serrated interior projections which oppose and inter-engage with the underside seating profile of the head unit in order to support and secure the head unit in a non-rotating fashion within either of the revised ring shank or pendant base constructions, and upon insertion and tightening of the set screw.
Figure 14:
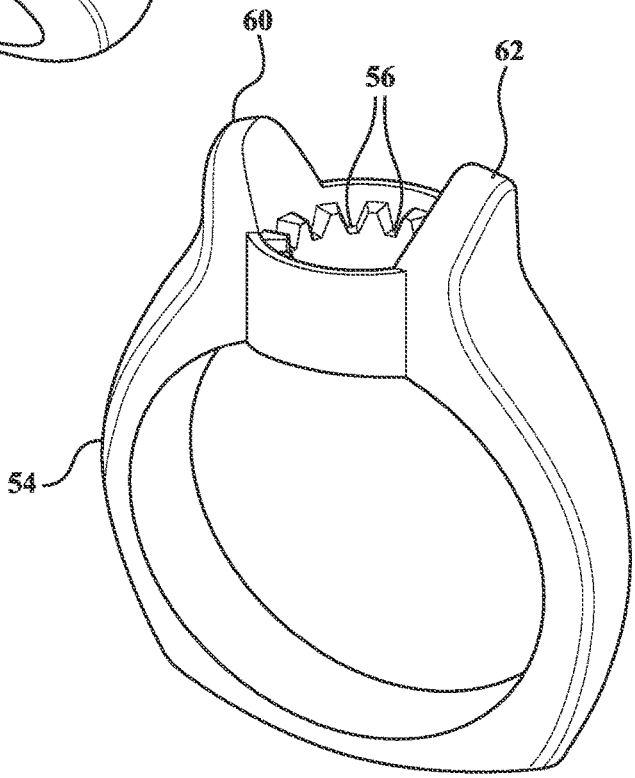
FIG. 14 is a side view of the ring shank in FIG. 13 and illustrating the gemstone seating and interior support structure for seating the head unit and receiving the interior set screw.
Figure 15:
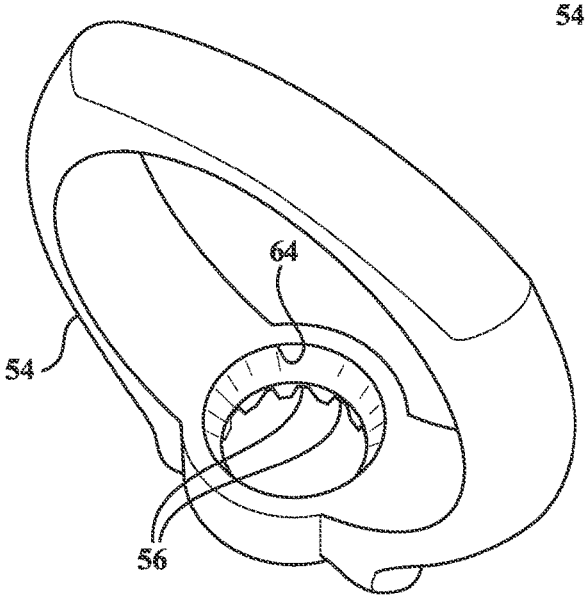
FIG. 15 is a further rotated bottom perspective of the ring shank and depicting a reverse underside concave taper or inward profile for receiving the set screw so that the screw head is, upon being tightened, flush with an underside of the ring shank opposing the wearer's finger.

FIG. 13 is a downward looking perspective view of a separated and slightly modified ring shank 54 as compared to that shown at 16 in FIGS. 2, 2A and 3 of FIGS. 1 and 1A and depicting a shallower support base without the inner circumferential threaded profile for receiving the set screw, this in combination with the upper supported and interiorly threaded head unit 40 as previously identified in FIGS. 7-9. Also depicted at 56 is an alternate configuration of serrated interior projections, these surrounding an open interior aperture 58, and which oppose and inter-engage with the underside seating profile 52 of the head unit in order to define an effective cross platform support structure and to secure the head unit 40 in a secure and non-rotating fashion within either of the ring shank 54 or pendant (see further FIGS. 16-18) base upon insertion and tightening of the set screw;

FIG. 14 is a side view of the ring shank in FIG. 13 and further illustrating the interior support structure (see also upper end setting support projections 60 and 62) for seating the head unit 40 of FIGS. 7-9 and receiving the interior set screw. FIG. 15 is a further rotated bottom perspective of the ring shank 54 and depicting a reverse underside concave taper or surface 64 for seating an opposing taper associated with the enlarged head 26 of the set screw so that the screw head is, upon being tightened, flush with an underside of the ring shank opposing the wearer's finger.

FIG. 16 a downward looking view of a modified pendant component 66, in comparison to that shown at 12 in FIGS. 1, 1A and 6, and by which the pendant exhibits a shallower side profile without the provision of separate interior threads, for receiving the set screw 26 in combination with an upper supported and interiorly threaded head unit 40. Similar to the ring shank of FIG. 13, the pendant 66 includes a matching configuration of serrated interior projections 68 (compare to as shown at 56 for rink shank) which oppose and inter-engage with the underside seating profile projections 52 of the head unit 40 in order to define an effective cross platform structure for supporting and securing the head unit in a non-rotating fashion within the pendant base upon insertion and tightening of the set screw.

FIG. 17 is a side looking perspective of the pendant base of FIG. 16 and again depicting its shallower side profile in combination with the chain or other lanyard receiving loop 70 which is integrally formed with the base. FIG. 18 is a rotated underside perspective of the pendant base bottom according to the alternate configuration of FIG. 16 and, similar to the ring shank bottom depiction of FIG. 15, depicts an optional reverse underside concave or inward taper, see at 72, for receiving the set screw so that the screw head is, upon being tightened, flush with an underside of pendant base. Without limitation, the inter-seating profile established between the annular receiving underside surface of the pendant base or rink shank and the rim edge of the set screw head can be altered as desired and so that, upon inserting and tightening the screw, the selected display arrangement provides a smooth and attractive appearance.

Figure 19:
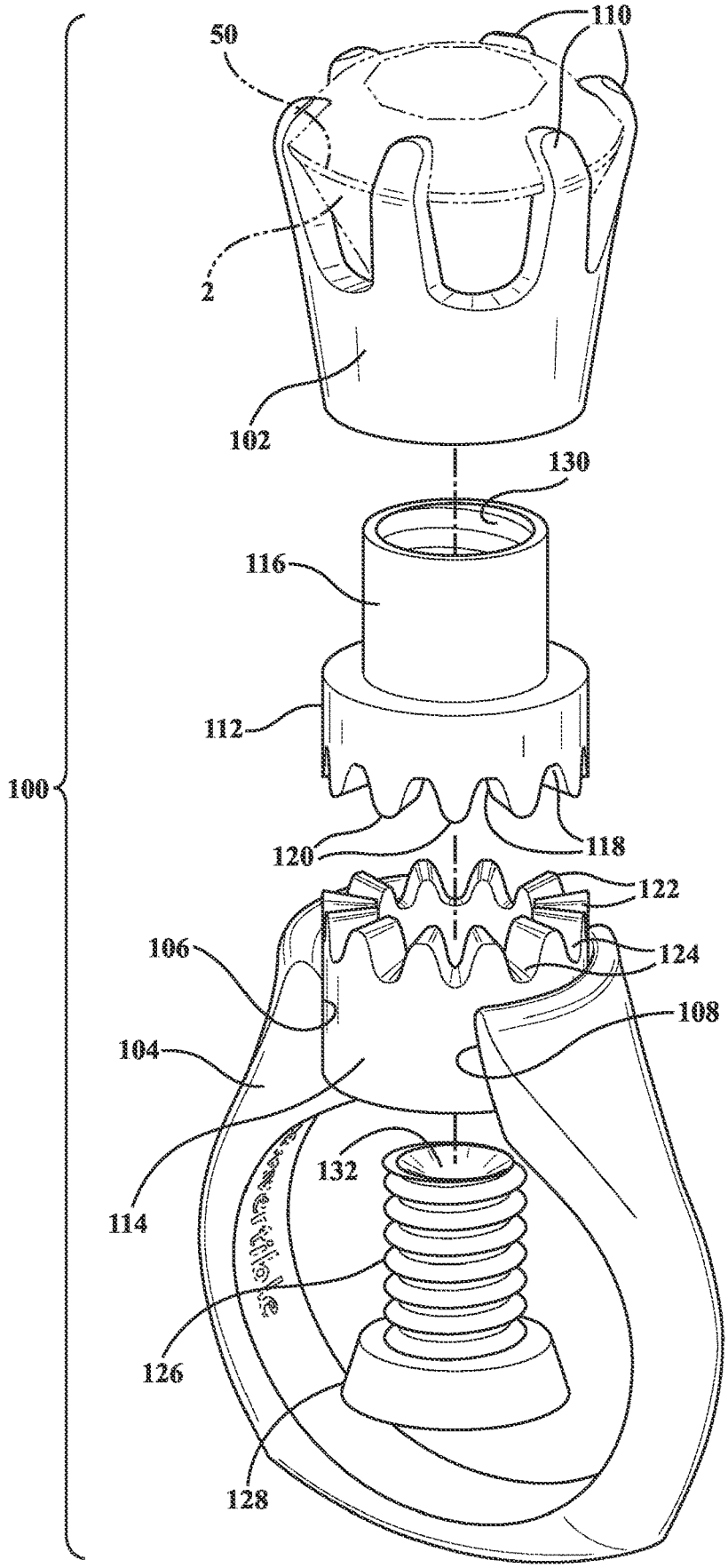
FIG. 19 is an exploded view of a retrofit variant of the kit assembly according to a further embodiment and exhibiting each of a traditional gemstone soldered to an upper core portion, with an inter-fitting lower core portion attached to a ring component and an underneath engageable screw securing the core portions together.

Proceeding now to FIG. 19, an exploded view is generally shown at 100 of a retrofit variant of the kit assembly for use with a conventional gemstone supporting head unit 102 and a ring 104 exhibiting opposing and spaced apart upper ends 106 and 108. The conventional gemstone supporting head unit 102 can be of an existing design, such including a hollow interior terminating in a smooth bottom profile. Otherwise, the head unit 102 includes a similar arrangement of upper angled or sloped gripping prongs or fingers 110 for gripping the gemstone about its outer diameter parting line 50. Reference is again made to the gripping finger profiles of FIGS. 8-8A.

The retrofit kit further includes each of an upper core 112 and an opposing lower core 114 for respectively securing/affixing to the head unit 102 and ring 104. The upper core 112 (also synonymously termed as an upper component or portion) includes an inner diameter extending shank 116 which can seat within the open underside (not shown) of the head unit 102 and be heat soldered or otherwise fixedly secured thereto. To this end, the upper and lower core portions 112/114 can be constructed of a metallic material, similar to the head unit 102 and ring 104 however it is understood that the cores and associated heat unit/jewelry item, can be constructed of other materials and can be secured or joined in other fashions not limited to adhesives or other mechanical joining options.

An outer diameter and lower most annular portion of the upper core (again depicted at 112) can include an underside facing and circumferential three dimensional patterning, this depicted as alternating projections 118 and recesses 120 similar to that referenced on the underside of the head unit in the preceding variants of FIGS. 8-9. The lower core 114 likewise includes a generally annular shaped body which is soldered or otherwise secured between inner facing profile surfaces associated with the spaced apart upper ends 106/108 of the ring.

An upper surface of the lower core 114 opposes the underside pattern of the upper core and includes a likewise upper facing pattern of mating and alternating pattern of projections 122 and recesses 124. Upon downwardly installing the combination head unit 102 and upper core 112 upon the lower core 114, the opposing patterns nest to prevent the head unit 102 and upper core 112 from rotating relative to the lower core 114 and attached ring 104.

Figure 23:
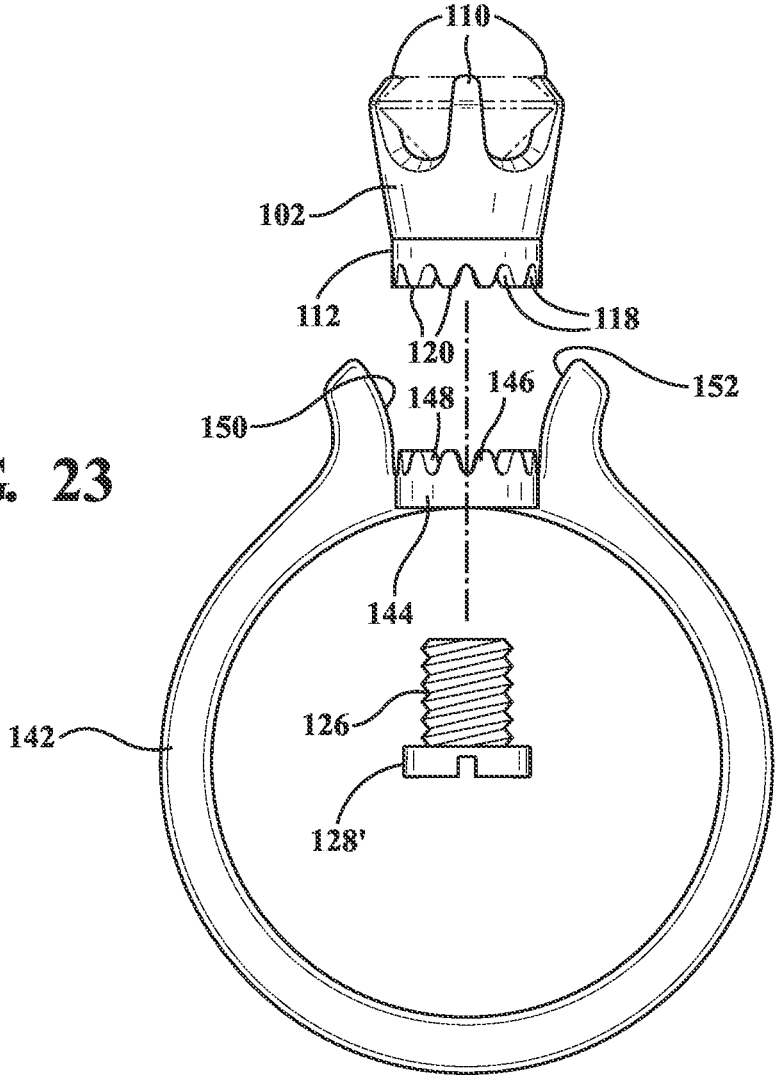
FIG. 23 is an exploded view of a reconfigured ring shown in cutaway and integrating a redesigned lower core.

Although not shown in FIG. 19, the lower core 114 includes an annular open underside for receiving a threaded stem portion 126 of a set or like engagement screw (see also enlarged and tapered head 128 which can also be non-tapered as shown at 128' in FIGS. 23-24). Similar to the previous embodiments, the lower core 114 and include an underside taper for mating and seating the head 128 so that the end of the screw head is arranged flush with the underside of the lower core. As further shown, the upper core includes inner threads 130 which rotationally inter-engage the exterior threads of the stem 126 upon installation and in order to secure the retrofit assembly together. Also depicted is a concave end face 132 of the set screw for ensuring proper seating relative to the opposing bottom of the gemstone 2 (not shown).

Figure 20:
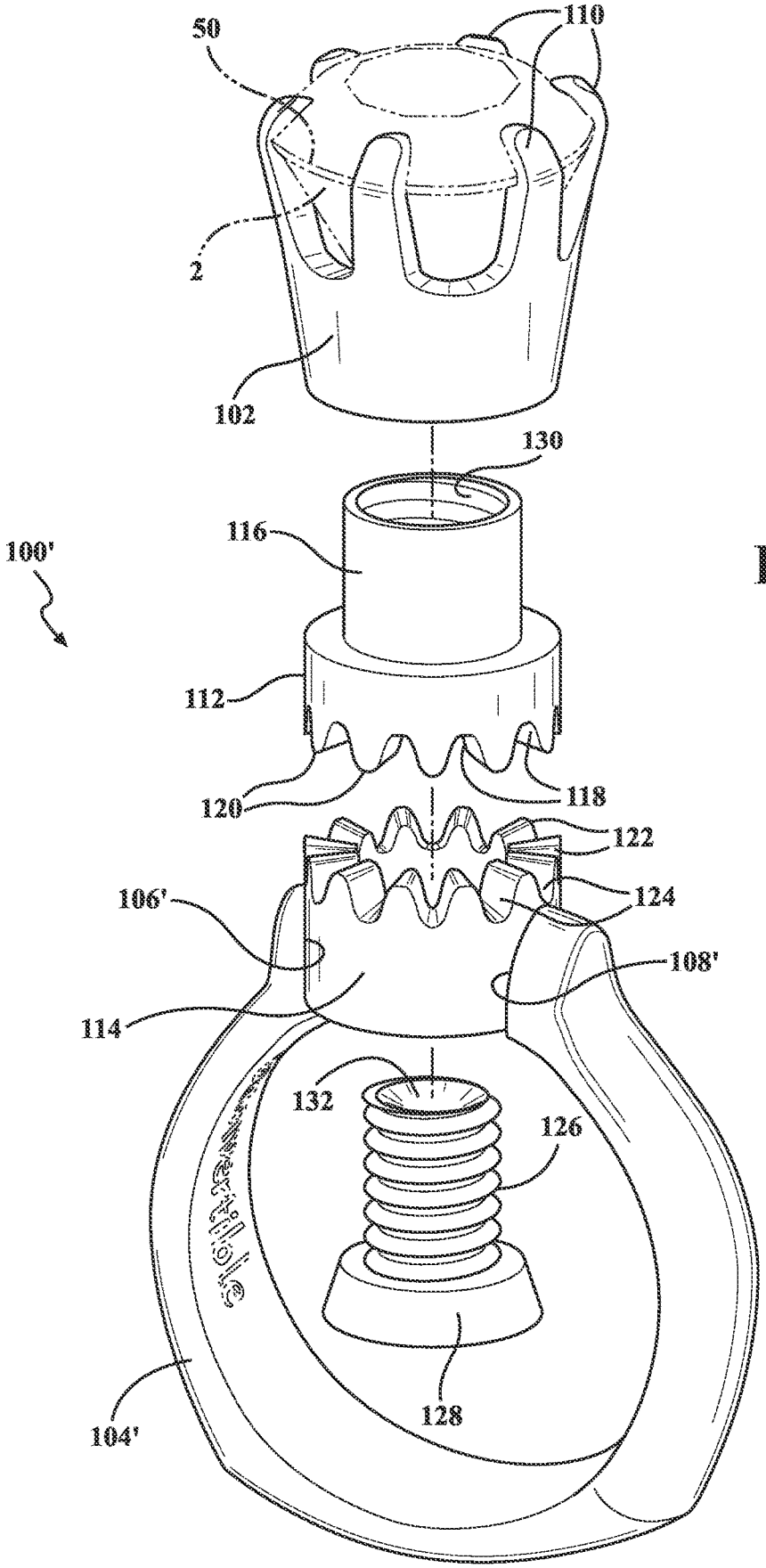
FIG. 20 illustrates an exploded view of a related variant to FIG. 19 and depicting an alternately configured ring component.
Figure 21:
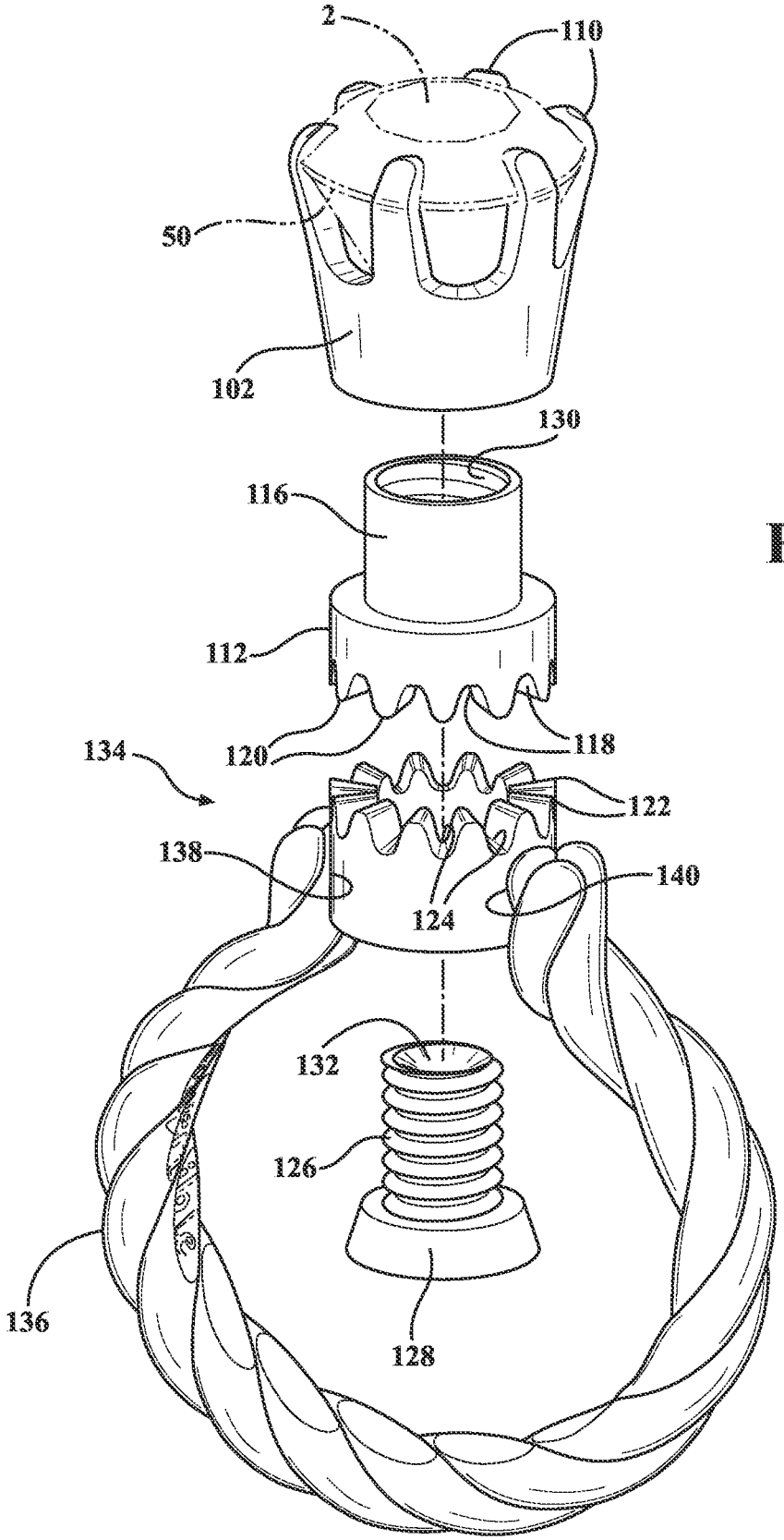
FIG. 21 illustrates a further exploded view of another related variant depicting another variation of any of a ring or bracelet component.

FIG. 20 illustrates an exploded view at 100' of a related variant to FIG. 19 and depicting an alternately configured ring component 104' with redesigned opposing upper end profiles 106'/108' between which the lower core 114 is soldered or otherwise secured. The remaining elements are generally identical to that depicted in FIG. 19 and are repetitively numbered. Referring further to FIG. 21, a further exploded view, generally at 134, is illustrated of another related variant depicting a further redesigned ring or bracelet component 136, this further having a braided profile extending between opposing and upper spaced apart end profiles 138 and 140.

Figure 22:
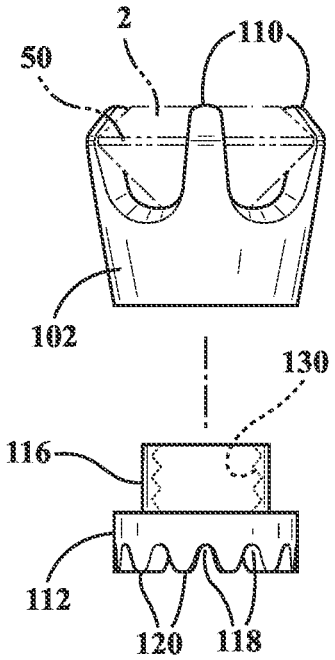
FIG. 22 is a subset exploded view of the upper core portion and traditional gemstone head unit and illustrating in phantom the inner threaded profile of the upper core.

FIG. 22 is a subset exploded view of the upper core 112 and traditional gemstone supporting head unit 102 and illustrating in phantom the inner threaded profile 130 defined within the upper core and portion. FIG. 23 is an exploded view and FIG. 24 is succeeding assembled view of a reconfigured ring shown in cutaway at 142 and integrating a redesigned lower core or portion, at 144. The lower core 144 includes a similar pattern of alternating recesses 146 and projections 148 for nesting the opposing recesses 118 and projections 120 of the upper core 112. A similarly designed set screw 126 with a non-tapered head 128' is provided and inserts from an underside direction through the open interior of the lower core portion prior to being threadably inter-engaged with the interior threads configured within the upper core 112. Also shown are configured upper ends 150/152 of the ring 142 between which the redesigned lower core 144 is engaged.

Figure 27:
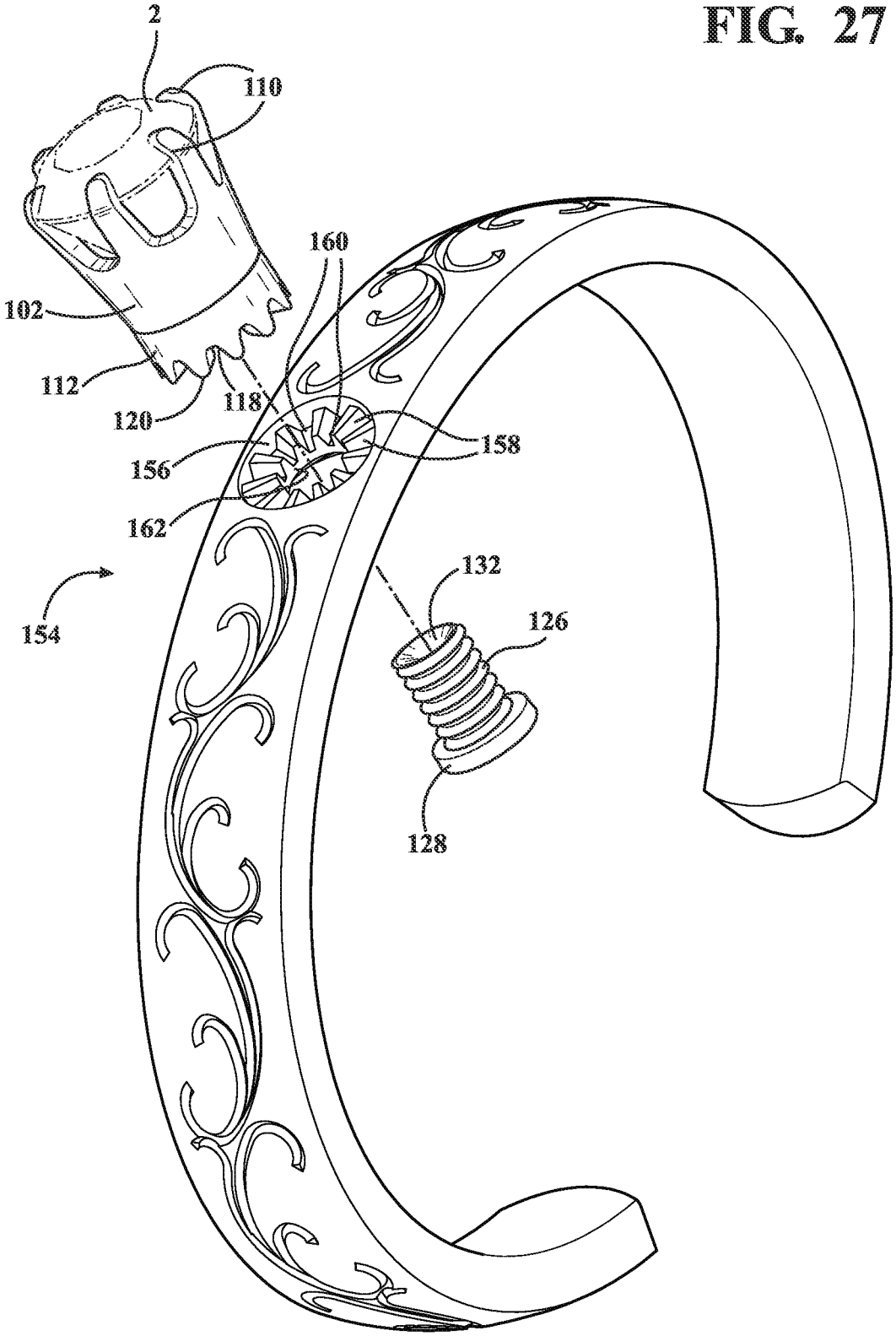
FIG. 27 is an illustration of a bracelet version of a retrofit kit assembly and depicting the lower core integrated into the bracelet.

FIGS. 25-26 depict each of perspective and plan cutaway views of the upper core portion depicted in FIG. 22 depicted in an inverted fashion to better show the underside alternating patterning. Finally, FIG. 27 is an illustration generally at 154 of a bracelet version of a retrofit kit assembly and depicting a lower core or portion, see as defined by annular recess profile at 156, which is integrated into the bracelet.

The lower core further includes a similar alternating pattern of projections 158 and recesses 160 which inter-nest with those depicted at 118/120 associated with the opposing upper core 112. In this manner, and upon the set screw 128 being inserted from an underside direction upwardly through the opening (see annular inner rim 162) of the lower core defining recess profile 156, the screw threadably engages with the threaded interior of the upper core 112 in order to engage the head unit 102 to the bracelet in the non-rotation fashion.

Having described my invention, other and additional preferred embodiments will become apparent to those skilled in the art to which it pertains, and without deviating from the scope of the appended claims. As previously described, this can include providing additional mounting applications not limiting to adapted the head unit for engagement to an appropriately configured set screw receiving component which can be integrated into any other jewelry or decorative item not limited to a broach, bracelet or, without limitation, other jewelry or decorative assembly. It is also envisioned that, alternate to an externally threaded set screw shank which inter-engages with additional and opposing interior threads formed upon at least the aligning aperture within the attachable head unit received upon the rink shank or pendant base, other envisioned variants can include the set screw and head unit including opposing twist and lock receiving profiles not limited to such as bayonet tab and slot features.

The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A jewelry kit for interchangeably supporting a gemstone upon each of multiple items of jewelry, comprising:

a head unit having a hollow interior with a bottom profile, said head unit further having a plurality of upper gripping fingers adapted for mounting the gemstone, an interiorly hollow upper core including an inner diameter shank and a lower outer diameter portion, said hollow interior of said head unit installing over said inner diameter shank until said bottom profile seats upon said outer diameter portion, a first plurality of alternating projections and recesses configured upon a circumferentially extending underside of said lower outer diameter portion which is outwardly spaced from a center axis extending through said upper core;

a plurality of items of jewelry including at least one of a ring, pendant, brooch or bracelet, an interiorly hollow lower core being integrated into each of the jewelry items and including a second plurality of alternating projections and recesses configured upon a circumferentially extending upper surface of said lower core which nests against said first plurality of projections and recesses of said upper core;

a screw having an exteriorly threaded stem inserting from an underside of said lower core and through said hollow interiors of said first and second aligning cores and engaging threads configured within said interior of said upper core for securing the gemstone upon any of the items of jewelry.

2. The jewelry kit as described in claim 1, said screw further comprising a concave end face in said stem adapted for seating an opposing bottom of the gemstone.

3. The jewelry kit as described in claim 1, said screw further comprising a tapered head, an opposing underside of said lower core further including a taper for mating and seating said head upon installation of said screw through said lower and upper cores.

4. The jewelry kit as described in claim 1, further comprising said first head unit being welded to said upper core.

* * * * *